US005724881A

United States Patent [19]

Reynolds

[11] Patent Number: 5,724,881

[45] Date of Patent: Mar. 10, 1998

[54] DIAPHRAGM ASSEMBLY FOR FLUID POWERED DIAPHRAGM PUMPS

[75] Inventor: Steven M. Reynolds, Lucas, Ohio

[73] Assignee: Warren Rupp, Inc., Mansfield, Ohio

[21] Appl. No.: 814,240

[22] Filed: Mar. 11, 1997

[51] Int. Cl.[6] ..... F16J 3/02

[52] U.S. Cl. ..... 92/100; 92/103 R

[58] Field of Search ..... 92/100, 103 R, 92/103 SD

[56] References Cited

U.S. PATENT DOCUMENTS

| | | | |
|---|---|---|---|
| 1,119,082 | 12/1914 | Inmam | 92/103 R |
| 1,806,360 | 5/1931 | Moller | 92/100 |
| 1,819,591 | 8/1931 | Carter | 92/103 R |
| 1,965,497 | 7/1934 | Johnson | 92/100 |
| 3,151,568 | 10/1964 | Hood et al. | 92/103 R |
| 3,781,141 | 12/1973 | Schall | 92/100 |

*Primary Examiner*—F. Daniel Lopez
*Attorney, Agent, or Firm*—Hilil, Steadman & Simpson

[57] ABSTRACT

A two-piece diaphragm assembly for a fluid powered diaphragm pump is provided. The diaphragm assembly includes a key as part of a overlay diaphragm extending towards a recess in a backup diaphragm, for properly aligning the overlay diaphragm and the backup diaphragm during installation of the diaphragm assembly. The diaphragm assembly also provides an improved mechanism for attaching the inner plate of the diaphragm assembly to the outer plate of the diaphragm assembly. A method of installing a two-piece diaphragm assembly onto a fluid powered diaphragm pump is also provided.

19 Claims, 4 Drawing Sheets

DIAPHRAGM ASSEMBLY FOR FLUID POWERED DIAPHRAGM PUMPS

FIELD OF THE INVENTION

The present invention is directed toward fluid powered diaphragm pumps and, more specifically, to diaphragm assemblies for fluid powered diaphragm pumps. Still more specifically, the present invention is directed toward a two-piece self-aligning diaphragm system for fluid powered diaphragm pumps.

BACKGROUND OF THE INVENTION

Fluid powered diaphragm pumps are known. One particularly successful design is illustrated in FIG. 1 which is a schematic illustration of a diaphragm pump sold under the SANDPIPER® trademark by Warren Rupp, Inc. of Mansfield, Ohio. The pump 10 as illustrated in FIG. 1 includes two diaphragm chambers shown at 11 and 12. Flexible diaphragms 13, 14 are mounted in each chamber 11, 12 respectively. The diaphragms 13, 14 divide the pumping sections, or the pumping chambers 11, 12, from the air driving section or air driving chambers shown at 15, 16. The two diaphragms 13, 14 are connected by a diaphragm rod 17.

As air enters the chamber 16, it drives the diaphragm 14 outward on a discharge/pump stroke. This action forces the liquid out of the chamber 12, through the check valve 18, through the manifold 19 and out the discharge outlet 21 as shown by the arrows 22, 23. As the diaphragm 14 is pushing the fluid out, the diaphragm rod 17 is pulling the diaphragm 13 inward on a suction stroke causing the chamber 11 to fill with fluid which enters through the inlet port 24, into the manifold 25 and through the check valve 26 as indicated by the arrows 27, 28. At the end of each stroke, the air distribution valve 29 automatically shifts, reversing the entire sequence. The check valve 31 prevents fluid that is being pumped from the Chamber 12 and out through the outlet 21 from entering the chamber 11 as illustrated in FIG. 1. Similarly, when fluid is being pumped from the chamber 11, through the manifold 19 and out the outlet 21, that fluid is prevented from entering the chamber 12 by the check valve 18. The check valves 26 and 32 both prevent fluid that is being pumped from the chambers 11, 12 respectively from entering the inlet manifold shown at 25.

The diaphragms shown schematically at 13, 14 in FIG. 1 are currently provided in three basic design configurations. Specifically, a one-piece diaphragm is provided which may be a polytetrafluroethylene (TEFLON®) facing that is bonded to a fabric reinforced elastomeric diaphragm backing, an injection molded thermoplastic diaphragm or other suitable diaphragm. The polytetrafluroethylene surface faces outward toward the pump chamber and is the surface that engages the fluid that is being pumped. Thus, if the diaphragm shown at 13, 14 in FIG. 1 were of the one-piece polytetrafluoethylene type, the surfaces shown at 33 and 34 would bear the polytetrafluoethylene facing and the surfaces shown at 35, 36 would be the fabric reinforced elastomeric portion.

One advantage of the one-piece polytetrafluroethylene diaphragm is that it is essentially "fool proof" in its installation. Specifically, no special alignment or fixturing is required to install these diaphragms in a pump like that shown at 10 in FIG. 1.

Two-piece diaphragms are also available, which are commonly referred to as overlay diaphragms. Typically, these diaphragm systems include an outer polytetrafluroethylene diaphragm that is overlayed on top of a fabric reinforced elastomeric diaphragm. The polytetrafluroethylene diaphragm is used on the fluid side, or at 33 and 34 as shown in FIG. 1 and the fabric reinforced elastomeric diaphragm is used on the air side, or at 35 and 36 in FIG. 1.

Polytetrafluroethylene is used as the outer diaphragm or the outer facing because of its good chemical resistance. However, polytetrafluroethylene is not a very strong material and must be replaced frequently when compared to fabric reinforced elastomeric diaphragms.

Therefore, the first component of the two-piece diaphragm to wear out is the polytetrafluroethylene overlay diaphragm. This component might be able to be replaced without replacing the elastomeric backup diaphragm assuming the supporting components have not become corroded resulting in damage to the backup diaphragm. In contrast, a disadvantage of the one-piece diaphragm is that the entire diaphragm must be replaced when the polytetrafluroethylene facing wears out.

In contrast, one disadvantage to the currently available two-piece diaphragm is the need to properly align the diaphragms during installation. Because the overlay and backup diaphragms must be properly aligned during installation, the installation is not fool proof like the installation of the one-piece diaphragms. A further disadvantage to the two-piece diaphragm is the means in which they are attached to the diaphragm rod. Specifically, the overlay and backup diaphragms are typically sandwiched between a threaded inner plate and an outer plate which includes a threaded stud. The inner plate is screwed onto the stud of the outer plate sandwiching the two diaphragms between the plates. Spinning the inner plate onto the outer plate in this fashion requires the operator to hold the diaphragms together to allow tightening or torquing of the assembly together. The friction between the inner plate and the backup diaphragm can cause false torque readings resulting in the assembly being insufficiently tightened which can result in the assembly becoming loose and leaking pumped product through to the air side of the pump.

Therefore, while one-piece diaphragms have the advantage of not requiring the installer to hold two diaphragms in alignment while tightening the inner plate against the outer plate, one-piece diaphragms are more expensive to maintain over the life of the pump than two-piece diaphragms because the entire one-piece diaphragm must be replaced as opposed to a two-piece diaphragm which normally requires replacement of only the overlay diaphragm. However, while less expensive over the life of the pump, two-piece diaphragms are difficult to install because the overlay diaphragm and the backup diaphragm must be held in alignment during installation and it is common to obtain false torque readings when the inner plate is being screwed onto the stud extending from the outer plate.

Accordingly, there is a need for an improved diaphragm system for fluid powered diaphragm pumps. Preferably, such a diaphragm system would combine the benefits of the two-piece diaphragm in terms of lower maintenance costs with the simplified installation provided by one-piece diaphragm systems.

SUMMARY OF THE INVENTION

It is therefore an object of the present invention to combine the benefits of a one-piece diaphragm in terms of ease of installation with the benefits of a two-piece diaphragm which enables the replacement of the backup diaphragm without replacing the backup diaphragm and further which enables the overlay diaphragm to be selected from a material designed to meet special system requirements such as resistance to corrosion or damage by the fluid being pumped.

In order to satisfy the above-referenced needs, the present invention provides an assembly for a two-piece diaphragm that includes an outer plate that engages an overlay diaphragm. The overlay diaphragm engages a backup diaphragm which, in turn, is disposed between the overlay diaphragm and an inner plate. A central stud extends outward from the outer plate and extends through the overlay and backup diaphragms and through the inner plate. The central stud is then connected to the diaphragm rod of the diaphragm pump.

However, the central stud does not serve as a means for attaching the inner plate to the outer plate. Instead, this function is provided by at least one, and preferably three, screws that are spaced radially outward from the central stud. The screws extend through the inner plate, through the two diaphragms and threadably connect the inner plate to the outer plate. The screws are radially spaced outward from the central stud and provide a secure engagement between the inner plate and outer plate.

In order to facilitate the alignment of the overlay diaphragm and the backup diaphragm, a key system is provided which effectively prevents any shifting or misalignment of the overlay diaphragm with respect to the backup diaphragm during the installation. An outwardly extending key or flange is provided on the overlay diaphragm which is accommodated in a recessed area or hole disposed in the backup diaphragm.

In an embodiment, at least one of the holes in the overlay diaphragm that accommodates a screw includes an outwardly extending flange. The flange is accommodated in an outer periphery of a hole in the backup diaphragm that also accommodates the same screw. The engagement between the flange of the overlay diaphragm and the outer periphery of the hole of the backup of the diaphragm provides a key and slot alignment between the overlay diaphragm and backup diaphragm thereby eliminating the need for any additional efforts to keep the overlay diaphragm and a backup diaphragm aligned during installation of the diaphragm assembly.

In an embodiment, the inner plate is not threadably connected to the central stud. Instead, flat head or round head screws extend through the inner plate and through the two diaphragms and engage threaded holes in the outer plate to threadably connect the inner plate to the outer plate.

In an embodiment, three screws are utilized to connect the inner plate to the outer plate, the screws being spaced radially outward from the central stud that connects the diaphragm assembly to the diaphragm rod and circumferentially spaced around the inner plate.

In an embodiment, the overlay diaphragm includes a hole for each screw used to attach the inner plate to the outer plate. At the outer periphery of each hole in the overlay diaphragm which accommodates a screw, an outwardly extending flange is provided. Further, a hole is provided in each backup diaphragm for each screw used to attach the inner plate to the outer plate. The width of each hole in the backup diaphragm is sufficiently large to accommodate both a screw and an outwardly extending flange of the overlay diaphragm.

In an embodiment, the overlay diaphragm is made from polytetrafluoroethylene.

In an embodiment, the overlay diaphragm is made from a material that will not be damaged by the fluid being pumped and/or is made from a material designed to meet special system requirements.

In an embodiment, the backup diaphragm is made from a fabric reinforced elastomer.

In an embodiment, the backup diaphragm is made from a material that will not be damaged by the fluid being pumped and/or is made from a material designed to meet special system requirements.

In an embodiment, the backup diaphragm is made from a material selected from the group consisting of polymerized butadiene, neoprene rubber, copolyester, acetal homopolymer, polypropylene, polyvinylidene fluoride, and polyphenylene sulfide.

The present invention also provides an improved method for installing two-piece diaphragm assemblies to diaphragm pumps. The method comprises the steps of attaching a stud to an outer plate, mounting an overlay diaphragm over the stud and mounting a backup diaphragm over the stud and the overlay diaphragm. The radially spaced holes in the overlay diaphragm and the backup diaphragm are aligned and the peripheral flange of the overlay diaphragm is inserted into the radially spaced hole of the backup diaphragm to align the overlay and backup diaphragms. The inner plate is then mounted over the stud and the backup diaphragm. The radially spaced holes of the inner plate, backup diaphragm, overlay diaphragm and outer plate are then placed in alignment. The screw is then inserted through the inner plate and is threadably connected onto the outer plate. As the screw is tightened within the threaded hole of the outer plate, the head of the screw draws the inner plate toward the outer plate. A predetermined amount of torque is used to tighten the screw.

In an embodiment, three radially spaced screws are used to provide the connection between the inner and outer plates.

The present invention also provides an improved diaphragm pump incorporating the improved diaphragm assembly of the present invention.

Other objects and advantages of the present invention will become apparent upon reading the following detailed description and appended claims, and upon reference to the accompanying drawings.

BRIEF DESCRIPTION OF THE DRAWINGS

The drawings show three exemplary embodiments of the diaphragm assembly of the present invention. Specifically.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
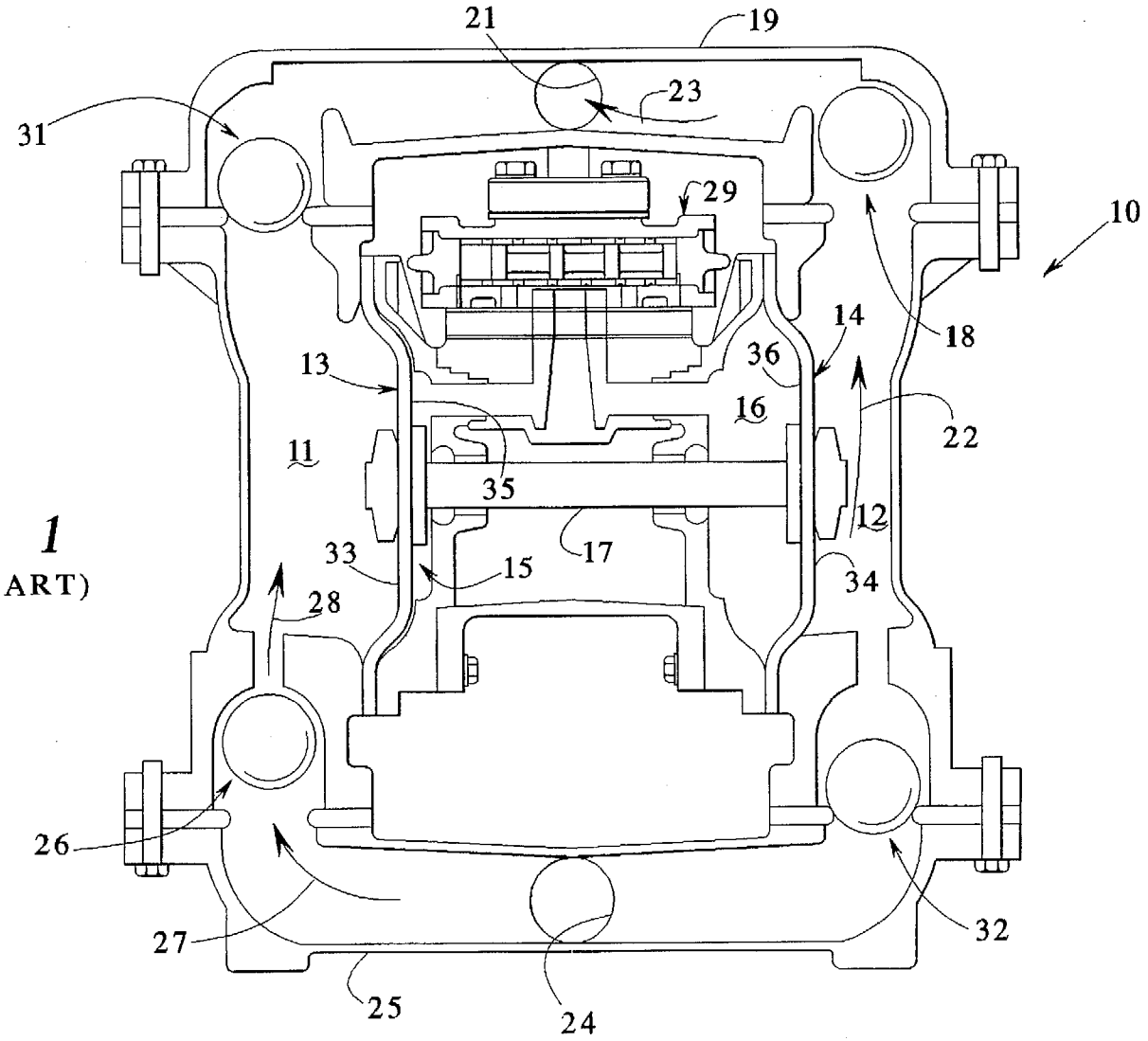
FIG. 1 (PRIOR ART)
FIG. 1 is a schematic illustration of a prior art fluid powered diaphragm pump.
Figure 2:
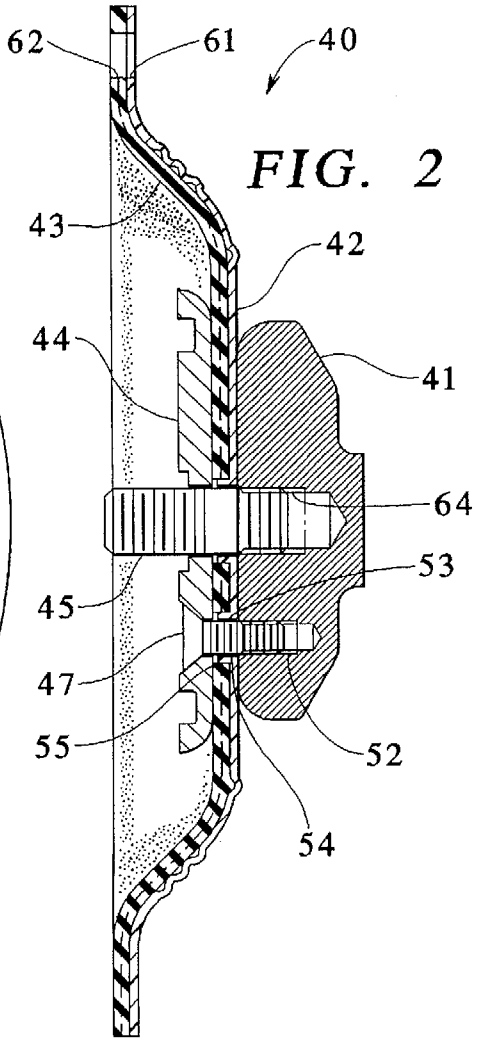
FIG. 2 is a side sectional view of a diaphragm assembly made in accordance with the present invention.

Turning first to FIG. 2, a diaphragm assembly 40 made in accordance with the present invention is illustrated. The diaphragm assembly 40 includes an outer plate 41, an overlay diaphragm 42, a backup diaphragm 43 and an inner plate 44. A central stud 45 is provided to connect the assembly 40 to the diaphragm rod 17 shown in FIG. 1. As noted above, the central stud 45 was previously used by prior art assemblies to threadably connect the inner plate 44 to the outer plate 41 and, consequently, prior art inner plates are threaded at the central aperture. In contrast, the inner plate 44 as shown in FIG. 2 is not threaded at its central aperture 46 (see FIG. 3). Instead, the connection between the inner plate 44 and the outer plate 41 is achieved through the use of three screws, one of which is shown at 47 in FIG. 2. The screws extend through three holes through the inner plate shown at 48, 49 and 50 in FIG. 3. Radially and circumferentially aligned holes also extend through the backup diaphragm 43 and the overlay diaphragm 42. Three threaded holes are provided in the outer plate 41, one of which is shown at 52 in FIG. 2.

Connecting the assembly 40 in this manner, the inner plate 44 does not need to be spun onto the stud 45 which, in the past, has caused wear problems on the overlay diaphragm 43. Further, spinning the inner plate 44 onto the stud 45 can cause friction between the inner plate 44 and the backup diaphragm 43 which, in the past, has resulted in false torque readings and an insufficient tightening of the inner plate 44 onto the stud 45. By utilizing at least one, and preferably three, radially spaced screws to positively connect the inner plate 44 to the outer plate 41, the present invention avoids these problems.

Still referring to FIG. 2, the overlay diaphragm 42 includes a flange 53 that surrounds the hole 54 in the overlay diaphragm 42 that accommodates the screw 47. The flange 53, in turn, is accommodated in the hole 55 provided in the backup diaphragm 43 that accommodates the screw 47. In a preferred embodiment, each radially spaced hole in the overlay diaphragm 42 that accommodates a screw is equipped with a flange, such as the one shown at 53 in FIG. 2. Similarly, in a preferred embodiment, each radially spaced hole 55 in the backup diaphragm 43 that accommodates a screw provides additional clearance to accommodate the flange such as the one shown at 53 in FIG. 2. In effect, the flange 53 of the overlay diaphragm 42 is used as a key and the enlarged hole 55 of the backup diaphragm 43 is used as a slot in a key and slot arrangement which results in the alignment of the holes 61,62 in the outer periphery of the diaphragms 42, 43 respectively.

Figure 3:
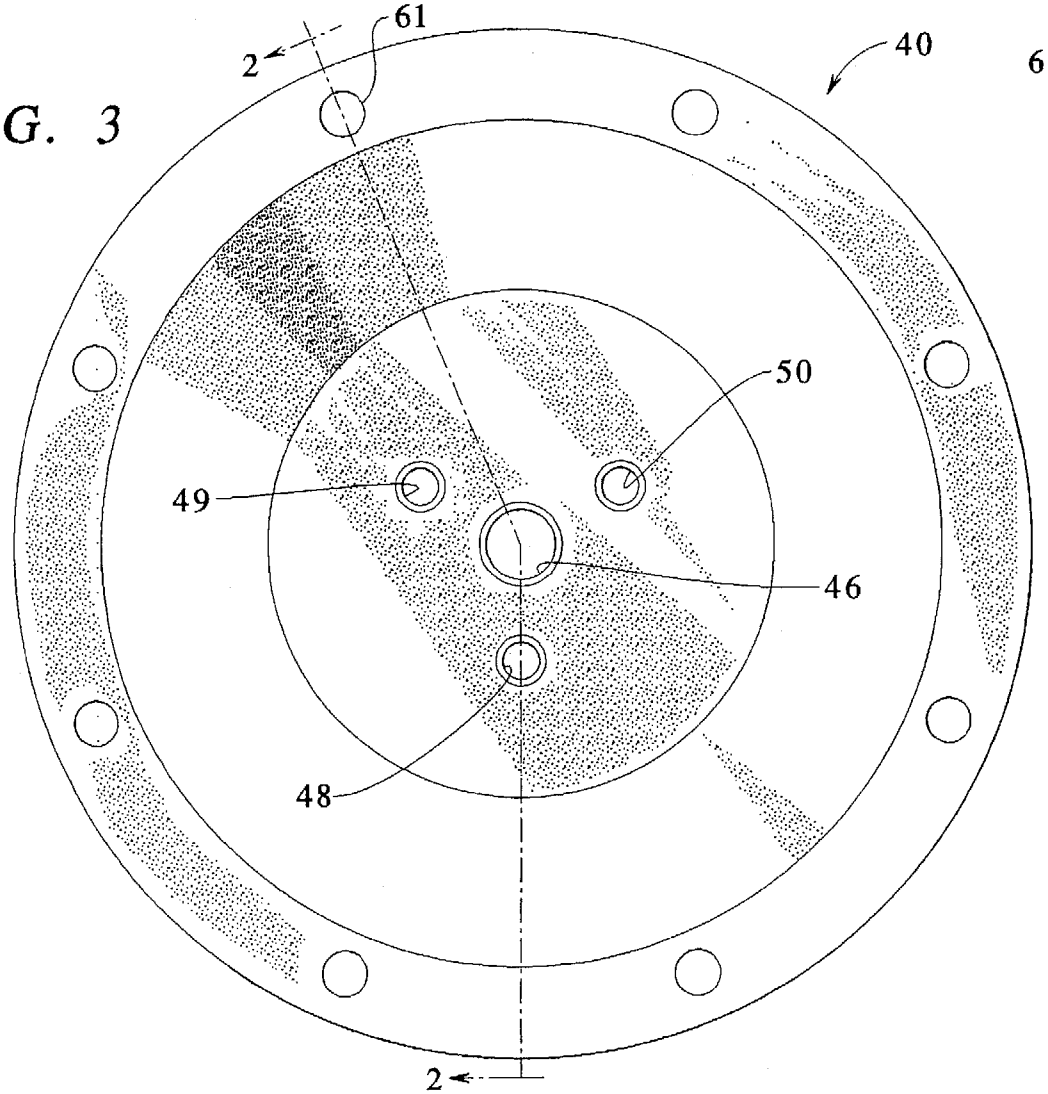
FIG. 3 is a plan view of the diaphragm assembly shown in FIG. 2.
Figure 4:
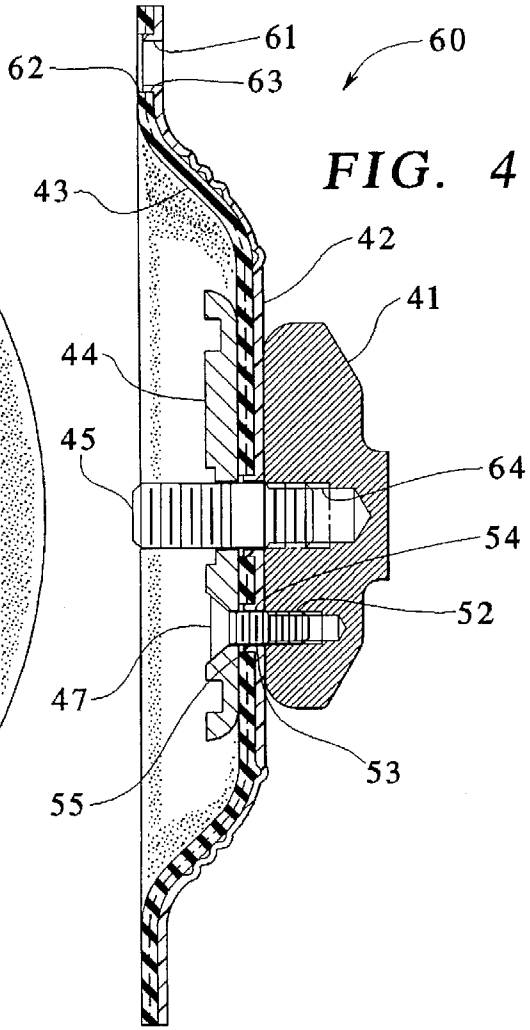
FIG. 4 is a side sectional view of a second diaphragm assembly made in accordance with the present invention.
Figure 5:
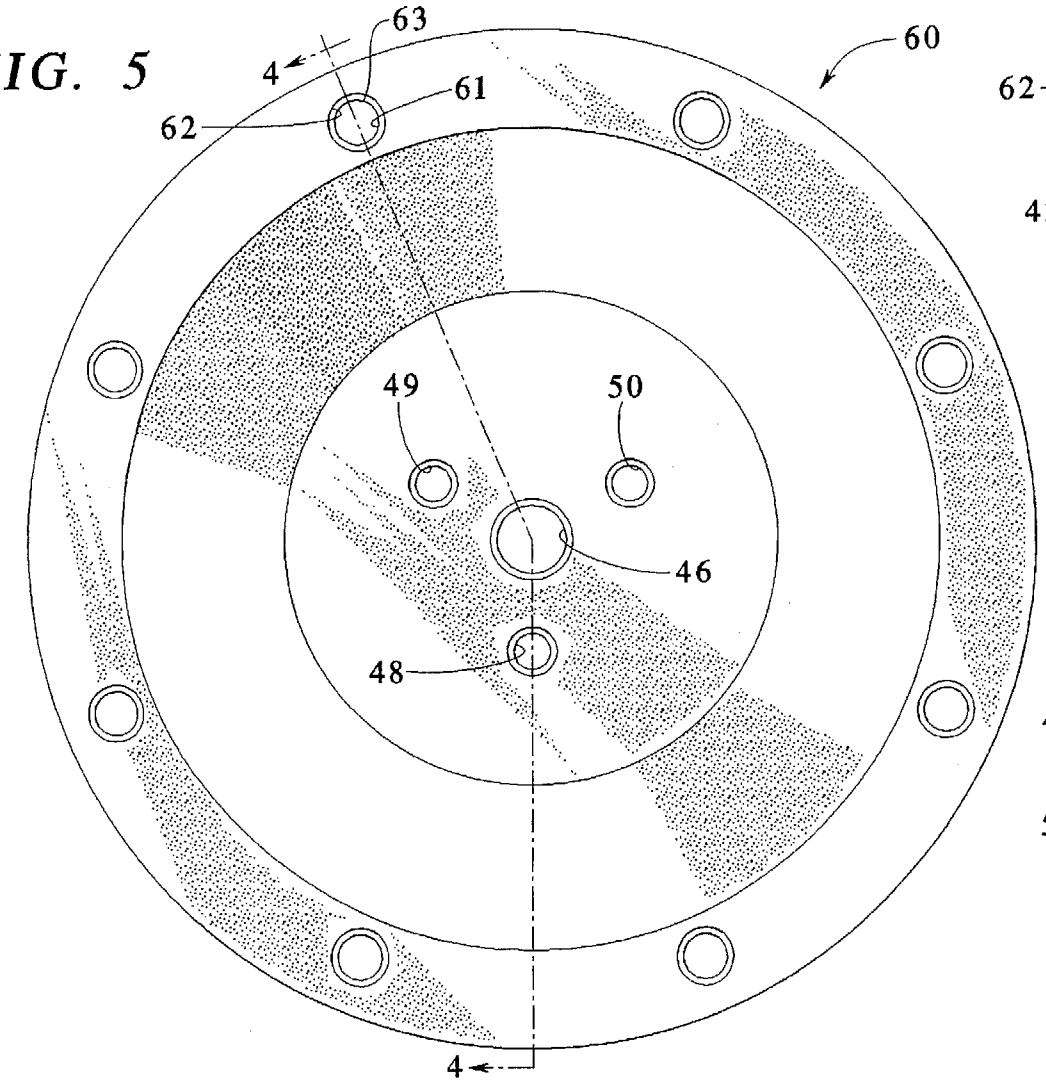
FIG. 5 is a plan view of the diaphragm assembly shown in FIG. 4.

The key and slot arrangement illustrated in FIGS. 2 and 3 is also provided in the diaphragm assembly 60 illustrated in FIGS. 4 and 5. Specifically, when the flange 53 which surrounds the hole 54 of the overlay diaphragm 42 is accommodated in the hole 55 of the backup diaphragm 43, the peripheral hole 61 of the overlay diaphragm 42 is also in alignment with the peripheral hole 62 of the backup diaphragm 43. In the embodiment shown in FIG. 4, the peripheral hole 61 of the overlay diaphragm 42 is equipped with a flange 63.

Figure 6:
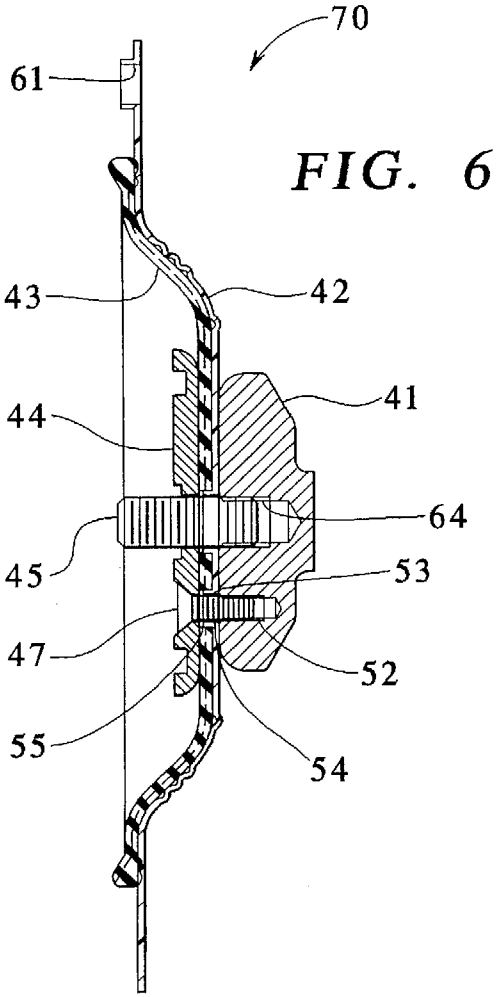
FIG. 6 is a side sectional view of a third diaphragm assembly made in accordance with the present invention.
Figure 7:
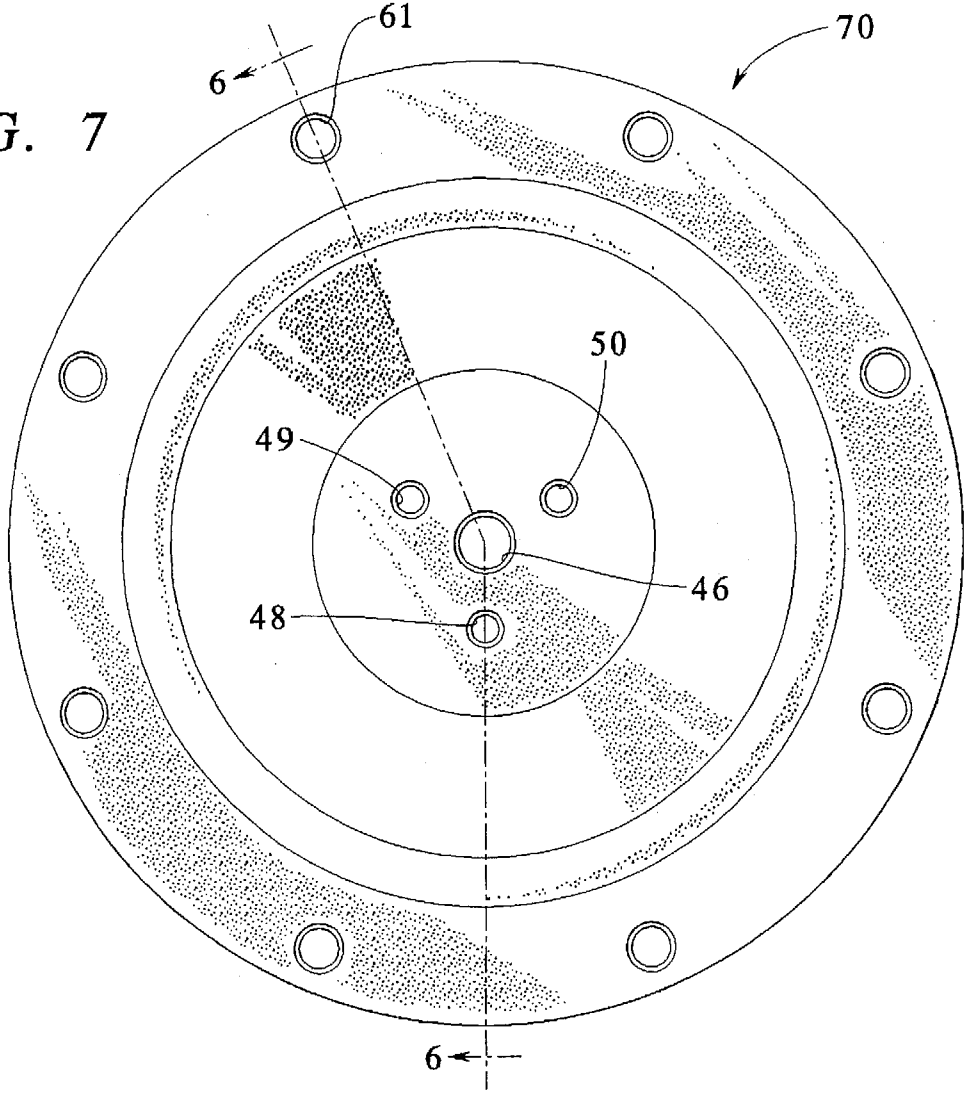
FIG. 7 is a plan view of the diaphragm assembly shown in FIG. 6.

In contrast, in the assembly 70 illustrated in FIG. 6, the outer periphery of the backup diaphragm 43 does not extend out to the hole 61 in the outer periphery of the overlay diaphragm 42.

Thus, the present invention provides an improved fool proof means for obtaining the correct alignment between the overlay diaphragm 42 and the backup diaphragm 43. By providing a flange, such as the one shown at 53 in FIGS. 2, 4 and 6, and a hole 55 in the backup diaphragm 43 that is larger than necessary to accommodate a screw, such as the one shown at 47, the present invention provides a key-in-slot aligning mechanism between the overlay diaphragm 42 and the backup diaphragm 43. Additional flanges may be provided such as the one shown at 63 in the peripheral hole 61 of the overlay diaphragm 42. In addition, flanges such as the one shown at 53 may be provided at each radially spaced hole in the overlay diaphragm 42 that is used to accommodate a fastening screw, only one of which is illustrated at 47 in FIGS. 2, 4 and 6.

To install the diaphragm assemblies 40, 60 and 70, the following procedure is employed. The stud 45 is screwed into the threaded hole 64 of the outer plate 41 as shown in FIGS. 2, 4 and 6. The overlay diaphragm 42 and backup diaphragm 43 are then mounted over the stud 45. The radially spaced holes 54 of the overlay diaphragm 42 and 55 of the backup diaphragm 43 are then shifted to an aligning position. Then, the flange 53 of the overlay diaphragm 42 is inserted into the outer periphery of the hole 55 of the backup diaphragm 43. This step places the overlay diaphragm 42 and backup diaphragm 43 into an aligning engagement. The inner plate 44 is then mounted over the stud 45 and the radially spaced holes of the inner plate 44, backup diaphragm 43, overlay diaphragm 42 and outer plate 41 are then placed in alignment so the screws, one of which is shown at 47, can be inserted through the aligned holes and the inner plate 44 can be threadably connected to the outer plate 41. The connection between the inner plate 44 and the outer plate 41 can be accomplished using a pre-determined amount of torque to ensure that the assemblies will be sufficiently tight and that no fluid will leak from the fluid side to the air side of the pump 10.

In a preferred embodiment, the overlay diaphragm 42 is made from polytetrafluoroethylene. Further, in a preferred embodiment, the backup diaphragm is made from fiber-reinforced elastomeric material. The backup diaphragm may also be made from polymerized butadiene, neoprene rubber, copolyester, acetal homopolymer, polypropylene, polyvinylidene fluoride, or polyphenylene sulfide. Currently available materials that are suitable for use in fabricating the backup diaphragms include: Nitrile NBR (Buna-N Nitrile), Ethylene Propylene (EPDM, Nordel®), Fluorocarbon (Viton®, Fluorel®), Chloroprene (Neoprene®), Polyurethane, Hytrel® Copolyester TPE, and Santoprene® Copolymer TPO.

From the above description, it is apparent that the objects of the present invention have been achieved. While only certain embodiments have been set forth, alternative embodiments and various modifications will be apparent from the above description to those skilled in the art. Specifically, various key and slot configurations between the overlay diaphragm 42 and backup diaphragm 43 may be provided in addition to the flange/enlarged hole combination illustrated in FIGS. 2, 4 and 6. Further, the number of radially spaced screws and corresponding holes used to attach the inner plate 44 to the outer plate 41 may be varied. Further, other fastening mechanisms in addition to screws may be employed. These and other alternatives are considered equivalents and within the spirit and scope of the present invention.

What is claimed is:

1. An assembly for a two-piece diaphragm, the assembly comprising:

an outer plate engaging an overlay diaphragm, the overlay diaphragm being disposed between the outer plate and a backup diaphragm, the backup diagram being disposed between the overlay diaphragm and an inner plate, the assembly further comprising a centrally disposed stud extending through the inner plate, the backup diaphragm, the overlay diaphragm and the outer plate, the assembly further comprising at least one screw spaced radially outward from the stud, the screw extending through the inner plate, the backup diaphragm, the overlay diaphragm and being threadably connected to the outer plate, the overlay diaphragm comprising a key extending outwardly toward the backup diaphragm, the backup diaphragm comprising an recessed area for accommodating the key of the backup diaphragm and ensuring proper alignment of the backup diaphragm against the overlay diaphragm.

2. The diaphragm assembly of claim 1 wherein the overlay diaphragm further comprises a radially spaced hole for accommodating the screw, the key comprising a flange extending around a periphery of the radially spaced hole and outward toward the backup diaphragm, the recessed area of the backup diaphragm being disposed around an outer periphery of a radially spaced hole for accommodating the screw and the key of the overlay diaphragm.

3. The diaphragm assembly of claim 1 further comprising a second radially spaced screw that extends through the inner plate, the backup diaphragm, the outer diaphragm to the outer plate, the overlay diaphragm comprising a second radially spaced hole for accommodating the second screw, the second radially spaced hole for accommodating the second screw comprising a second peripheral flange extending toward the backup diaphragm, the backup diaphragm comprising a second radially spaced hole for accommodating the second screw and the second peripheral flange of the overlay diaphragm.

4. The diaphragm assembly of claim 1 further comprising a third radially spaced screw that extends through the inner plate, the backup diaphragm, the outer diaphragm to the outer plate, the overlay diaphragm comprising a third radially spaced hole for accommodating the third screw, the third radially spaced hole for accommodating the third screw comprising a third peripheral flange extending toward the backup diaphragm, the backup diaphragm comprising a third radially spaced hole for accommodating the third screw and the third peripheral flange of the overlay diaphragm.

5. The diaphragm assembly of claim 1 wherein the overlay diaphragm is made from polytetrafluroethylene.

6. The diaphragm assembly of claim 1 wherein the backup diaphragm is made from an elastomer.

7. The diaphragm assembly of claim 1 wherein the backup diaphragm is made from a material selected from the group of elastomers consisting of polymerized butadiene, neoprene rubber, copolyester, acetal homopolymer, polypropylene, polyvinylidene fluoride, and polyphenylene sulfide.

8. An assembly for a two-piece diaphragm, the assembly comprising:

an outer plate engaging an overlay diaphragm, the overlay diaphragm being disposed between the outer plate and a backup diaphragm, the backup diagram being disposed between the overlay diaphragm and an inner plate, the inner and outer plates being held in alignment by a centrally disposed stud that extends through the inner plate to the outer plate, the inner and outer plates being connected by a first screw that extends through the inner plate and is threadably connected to the outer plate, the overlay diaphragm comprising a first radially spaced hole for accommodating the first screw, the first radially spaced hole for accommodating the first screw comprising a first peripheral flange extending toward the backup diaphragm, the backup diaphragm comprising a central hole for accommodating the stud and a first radially spaced hole for accommodating the first screw and the first peripheral flange of the overlay diaphragm.

9. The diaphragm assembly of claim 8 further comprising a second screw that extends through the inner plate to the outer plate, the overlay diaphragm comprising a second radially spaced hole for accommodating the second screw, the second radially spaced hole for accommodating the second screw comprising a second peripheral flange extending toward the backup diaphragm, the backup diaphragm comprising a second radially spaced hole for accommodating the second screw and the second peripheral flange of the overlay diaphragm.

10. The diaphragm assembly of claim 9 further comprising a third screw that extends through the inner plate to the outer plate, the overlay diaphragm comprising a third radially spaced hole for accommodating the third screw, the third radially spaced hole for accommodating the third screw comprising a third peripheral flange extending toward the backup diaphragm, the backup diaphragm comprising a third radially spaced hole for accommodating the third screw and the third peripheral flange of the overlay diaphragm.

11. The diaphragm assembly of claim 8 wherein the overlay diaphragm is made from polytetrafluroethylene.

12. The diaphragm assembly of claim 8 wherein the backup diaphragm is made from an elastomer.

13. The diaphragm assembly of claim 8 wherein the backup diaphragm is made from a material selected from the group of elastomers consisting of polymerized butadiene, neoprene rubber, copolyester, acetal homopolymer, polypropylene, polyvinylidene fluoride, and polyphenylene sulfide.

14. A two piece diaphragm comprising:

an overlay diaphragm and a backup diaphragm, the overlay diaphragm comprising a key extending outwardly toward the backup diaphragm, the backup diaphragm comprising a slot for accommodating the key of the backup diaphragm and ensuring proper alignment of the backup diaphragm against the overlay diaphragm.

15. An assembly for a two-piece diaphragm, the assembly comprising:

an outer plate engaging an overlay diaphragm, the overlay diaphragm being disposed between the outer plate and a backup diaphragm, the backup diagram being disposed between the overlay diaphragm and an inner plate, the backup and overlay diaphragms further comprising means for aligning the backup diaphragm against the overlay diaphragm, the inner and outer plates being connected by at least one screw that extends through the inner plate and is threadably connected to the outer plate.

16. The diaphragm assembly of claim 15 wherein said means for aligning the backup diaphragm against the overlay diaphragm comprises a flange disposed on the overlay diaphragm which is accommodated in a hole in the backup diaphragm.

17. The diaphragm assembly of claim 15 wherein said means for aligning the backup diaphragm against the overlay diaphragm comprises three flanges disposed on the overlay diaphragm which are accommodated in three holes in the backup diaphragm.

18. A method of installing a two-piece diaphragm assembly on a diaphragm pump having a diaphragm rod, the method comprising the following steps:

providing an outer plate, an Overlay diaphragm, a backup diaphragm, an inner plate, a threaded stud and a screw, the outer plate having a threaded central hole for threadably connecting the outer plate to the stud, the overlay diaphragm, backup diaphragm and inner plate each including a central hole for accommodating the stud, the outer plate further comprising at least on radially spaced threaded hole for threadably connecting the outer plate to the screw, the overlay diaphragm, backup diaphragm and inner plate each including a radially spaced hole for accommodating the screw, the overlay diaphragm further comprising an outwardly extending peripheral flange surrounding the radially spaced hole of the overlay diaphragm, attaching the stud to the outer plate, mounting the overlay diaphragm over the stud, mounting the backup diaphragm over the stud and the overlay diaphragm, aligning the peripheral flange of the overlay diaphragm with the radially spaced hole of the backup diaphragm, inserting the peripheral flange of the overlay diaphragm into the radially spaced hole of the backup diaphragm, mounting the inner plate over the stud and the backup diaphragm, aligning the radially spaced holes of the inner plate, backup diaphragm, overlay diaphragm and outer plate, inserting the screw through the radially spaced holes of the inner plate, backup diaphragm, overlay diaphragm and outer plate, threadably connecting the screw to the outer plate using a predetermined amount of torque.

19. A diaphragm pump comprising:

a pumping chamber and a drive chamber with a diaphragm assembly disposed therebetween, the diaphragm assembly comprising an outer plate engaging an overlay diaphragm, the overlay diaphragm being disposed between the outer plate and a backup diaphragm, the backup diagram being disposed between the overlay diaphragm and an inner plate, the assembly further comprising a centrally disposed stud extending through the inner plate, the backup diaphragm, the overlay diaphragm and the outer plate, the assembly further comprising at least one screw spaced radially outward from the stud, the screw extending through the inner plate, the backup diaphragm, the overlay diaphragm and being threadably connected to the outer plate, the overlay diaphragm comprising a key extending outwardly toward the backup diaphragm, the backup diaphragm comprising an recessed area for accommodating the key of the backup diaphragm and ensuring proper alignment of the backup diaphragm against the overlay diaphragm.

* * * * *